US007921917B2

(12) United States Patent
Kotrla et al.

(10) Patent No.: US 7,921,917 B2
(45) Date of Patent: Apr. 12, 2011

(54) MULTI-DEPLOYABLE SUBSEA STACK SYSTEM

(75) Inventors: Johnnie E. Kotrla, Katy, TX (US); Melvyn F. Whitby, Houston, TX (US); David J. McWhorter, Manolia, TX (US); Glenn J. Chiasson, Houston, TX (US)

(73) Assignee: Cameron International Corporation, Houston, TX (US)

( * ) Notice: Subject to any disclaimer, the term of this patent is extended or adjusted under 35 U.S.C. 154(b) by 321 days.

(21) Appl. No.: 12/134,958

(22) Filed: Jun. 6, 2008

(65) Prior Publication Data

US 2008/0302536 A1 Dec. 11, 2008

Related U.S. Application Data

(60) Provisional application No. 60/933,934, filed on Jun. 8, 2007.

(51) Int. Cl.
*E21B 7/12* (2006.01)

(52) U.S. Cl. ..... 166/339; 166/341; 166/351; 166/352; 166/358; 166/359; 166/360; 166/366; 166/367; 166/368; 166/85.4; 175/5

(58) Field of Classification Search ..... 166/341, 166/338, 339, 344, 351, 352, 359, 360, 366–368, 166/378, 381, 85.1, 85.4; 137/315.02; 175/5–10
See application file for complete search history.

(56) References Cited

U.S. PATENT DOCUMENTS

| | | | | |
|---|---|---|---|---|
| 4,116,272 | A | 9/1978 | Barrington | |
| 4,624,318 | A * | 11/1986 | Aagaard | 166/359 |
| 4,626,135 | A | 12/1986 | Roche | |
| 5,146,990 | A * | 9/1992 | Ritter, Jr. | 166/340 |
| 5,676,209 | A * | 10/1997 | Reynolds | 166/345 |
| 5,875,848 | A * | 3/1999 | Wolff et al. | 166/345 |
| 6,227,300 | B1 * | 5/2001 | Cunningham et al. | 166/339 |
| 6,408,947 | B1 * | 6/2002 | Cunningham et al. | 166/339 |
| 6,422,315 | B1 * | 7/2002 | Dean | 166/339 |
| 6,622,799 | B2 * | 9/2003 | Dean | 166/381 |
| 6,715,554 | B1 * | 4/2004 | Cunningham et al. | 166/348 |
| 6,968,902 | B2 * | 11/2005 | Fenton et al. | 166/358 |
| 7,063,157 | B2 * | 6/2006 | Bartlett | 166/339 |
| 7,134,498 | B2 * | 11/2006 | Hopper | 166/357 |
| 7,143,830 | B2 * | 12/2006 | Bartlett | 166/339 |
| 7,216,714 | B2 * | 5/2007 | Reynolds | 166/338 |
| 7,216,715 | B2 * | 5/2007 | Reynolds | 166/339 |
| 7,222,674 | B2 * | 5/2007 | Reynolds | 166/341 |
| 7,690,433 | B2 * | 4/2010 | Reynolds | 166/338 |
| 2007/0163782 | A1 * | 7/2007 | Keener | 166/358 |

* cited by examiner

*Primary Examiner* — Thomas B Will
*Assistant Examiner* — Matthew R Buck
(74) *Attorney, Agent, or Firm* — Conley Rose, P.C.

(57) ABSTRACT

Methods for deploying a subsea blowout preventer stack system comprising a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then toward a subsea wellhead and then landed on the additional blowout preventer package that is coupled to the subsea wellhead.

14 Claims, 5 Drawing Sheets

MULTI-DEPLOYABLE SUBSEA STACK SYSTEM

CROSS-REFERENCE TO RELATED APPLICATIONS

This application claims benefit of U.S. provisional application Ser. No. 60/933,934 filed Jun. 8, 2007, and entitled "Multi-Deployable Subsea Stack System," which is hereby incorporated herein by reference in its entirety for all purposes.

STATEMENT REGARDING FEDERALLY SPONSORED RESEARCH OR DEVELOPMENT

Not Applicable.

BACKGROUND

The present invention relates generally to the configuration and deployment of pressure control equipment used in drilling subsea wells. More particularly, the present invention relates to subsea blowout preventer stack systems.

As drilling rigs venture into ever increasing water depths and encounter new challenges, well control has become increasingly problematic. As costs of floating mobile offshore drilling units escalate, traditional time-intensive operations are constantly being re-evaluated in an effort to reduce overall non-drilling time, thereby increasing the drilling efficiency of the rig.

One of the most time-intensive operations is running the riser, which provides a plurality of parallel fluid conduits between the drilling rig at the surface and the blowout preventer (BOP) stack coupled to the wellhead at the seafloor. In order to facilitate handling of the riser on the rig, the riser is usually constructed by connecting a number of joints that are generally less than fifty feet in length. The riser is "run" by connecting a joint of riser to the BOP stack, lowering the riser-connected BOP stack a short distance, and then connecting another joint of riser to the uppermost end of the riser string. This process continues until the BOP stack is lowered to the wellhead at the seafloor.

In water depths in excess of 5,000 ft., running the riser generally takes several days to complete. Thus, minimizing the number of times the riser must be run is critical to minimizing the time needed to drill and complete a well. Since the BOP stack is installed at the very bottom of the riser, attempts to increase the amount of time that the BOP stack can stay on the wellhead are being explored. One factor limiting the time a BOP stack can stay on the wellhead is for maintenance of the ram BOP packer seals. Ram BOP packer seals have a limited useful life and once that limit is reached the ram BOP cannot be used until the seals have been replaced.

One common way to improve the time a BOP stack can stay on the wellhead is to increase the number of useable ram BOP cavities in the BOP stack to the point of having a "primary" and "secondary" ram BOP cavity for each size installed. In this way, the time that a BOP stack can remain operational on the wellhead would be effectively doubled. However, simply increasing the number of ram BOP cavities in a subsea BOP stack presents its own set of new challenges, such as increasing the size and weight of the BOP stack.

Drilling in deep water has often utilized subsea BOP stacks having four to six ram BOP cavities. Increasing the number of ram BOP cavities, such as to eight or ten cavities would increase the weight of the BOP stack, in some cases to a million pounds or more. Many existing rigs do not have the capacity to handle and operate such a BOP stack. In order to safely operate such a system, enhancements would be required to not only the BOP stack handling equipment on the rig, but also to the drill floor equipment, the drawworks and other hoisting equipment, the rotary table, the derrick, and the riser. Enhancing all of this equipment would likely require expanding the basic rig design to allow it to carry the additional weight of all the enhanced equipment systems and provide room for handling and storing the BOP stack.

Thus, there remains a need to develop methods and apparatus for allowing improved redundancy and operational times of subsea BOP stacks in order to overcome some of the foregoing difficulties while providing more advantageous overall results.

SUMMARY OF THE PREFERRED EMBODIMENTS

The embodiments of the present invention are directed toward methods for deploying a subsea blowout preventer stack system comprising a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then lowered toward a subsea wellhead and landed on the additional blowout preventer package that is already in place on the subsea wellhead. In certain embodiments, neither a drilling rig nor the drilling riser is used to deploy and land the first additional blowout preventer package on the subsea wellhead. During drilling operations, the ram blowout preventers in the first additional blowout preventer package can be used as the primary blowout preventers, leaving the ram blowout preventers in the blowout preventer stack unused.

In one deployment method, a first additional blowout preventer package is deployed on a first wellhead and a second additional blowout preventer package is deployed on a second subsea wellhead. The BOP stack is landed on the first additional blowout preventer package and drilling operations performed through the first wellhead using the ram blowout preventers of the first additional blowout preventer package as the primary blowout preventers. Once drilling is complete at the first wellhead, the blowout preventer stack is disconnected from the first additional blowout preventer package landed on the second additional blowout preventer package. In this method, the blowout preventer stack can stay subsea while drilling several wells using more than one additional blowout preventer package.

In some deployment methods, a second additional blowout preventer package is deployed to a subsea parking pile. Once the useful life of the first additional blowout preventer package has been reached the blowout preventer stack is disconnected from the first additional blowout preventer package and landed on the second additional blowout preventer package. The first additional blowout preventer package is then disconnected from the subsea wellhead and retrieved to the surface while the blowout preventer stack and the second additional blowout preventer package are landed on the subsea wellhead. Thus, the blowout preventer stack can remain subsea with minimal disruption to the drilling program while the additional blowout preventer packages are retrieved and maintained.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
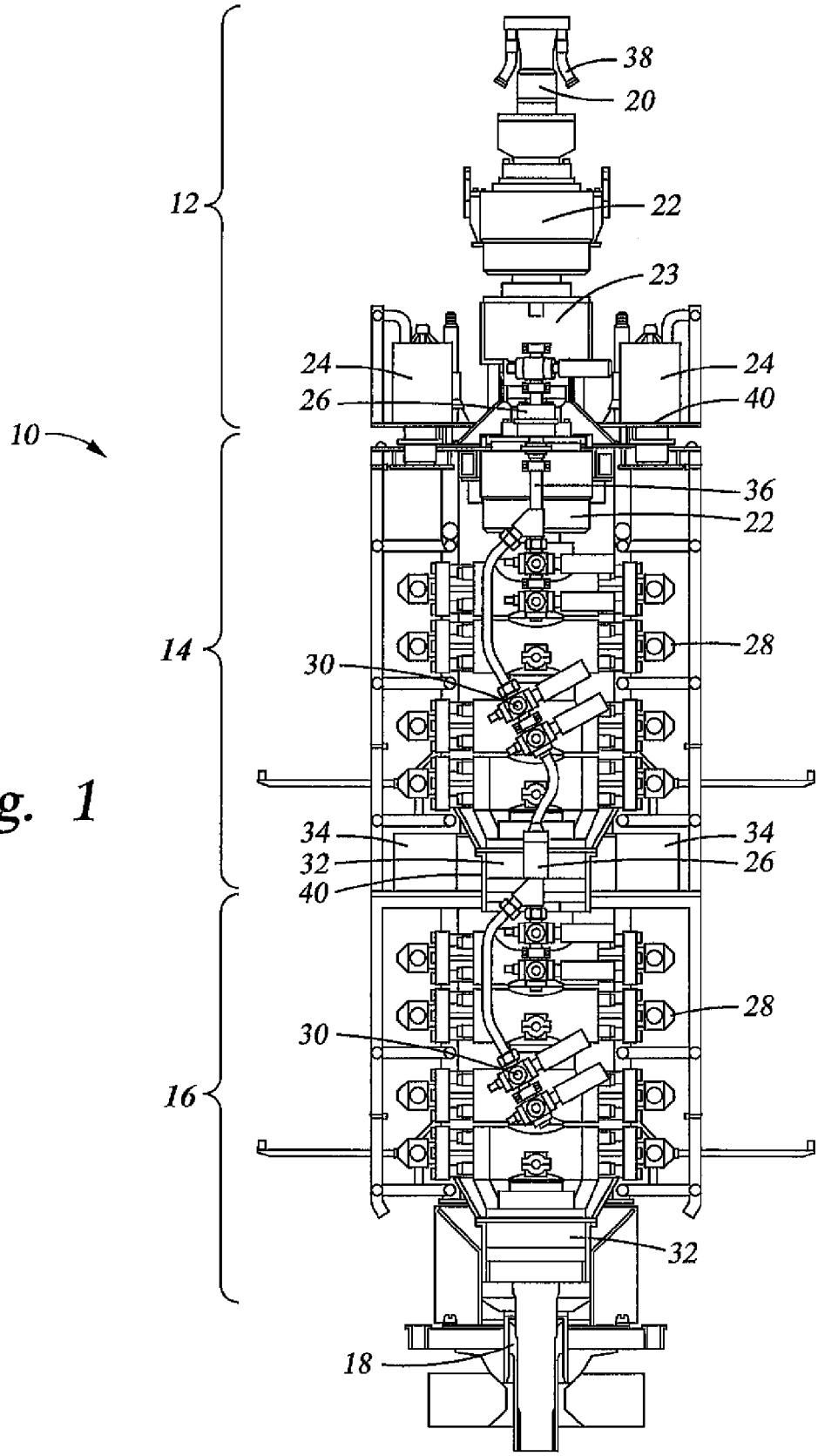
FIG. 1 is an elevation view of a blowout preventer stack system constructed in accordance with embodiments of the present invention.

Referring now to FIG. 1, subsea BOP stack system 10 comprises lower marine riser package (LMRP) 12, BOP stack 14, and additional BOP package (ABP) 16. Stack system 10 is shown in FIG. 1 landed on subsea wellhead 18. LMRP 12 comprises a flex joint/riser connector 20, annular BOP 22, wellbore connector 23, control pods 24, and choke/kill line connectors 26. BOP stack 14 comprises annular BOP 22, ram BOP's 28, choke/kill line connectors 26, choke/kill valves 30, wellbore connector 32, and auxiliary control pods 34. ABP 16 comprises ram BOP's 28, choke/kill valves 30, and wellbore connector 32.

Figure 2:
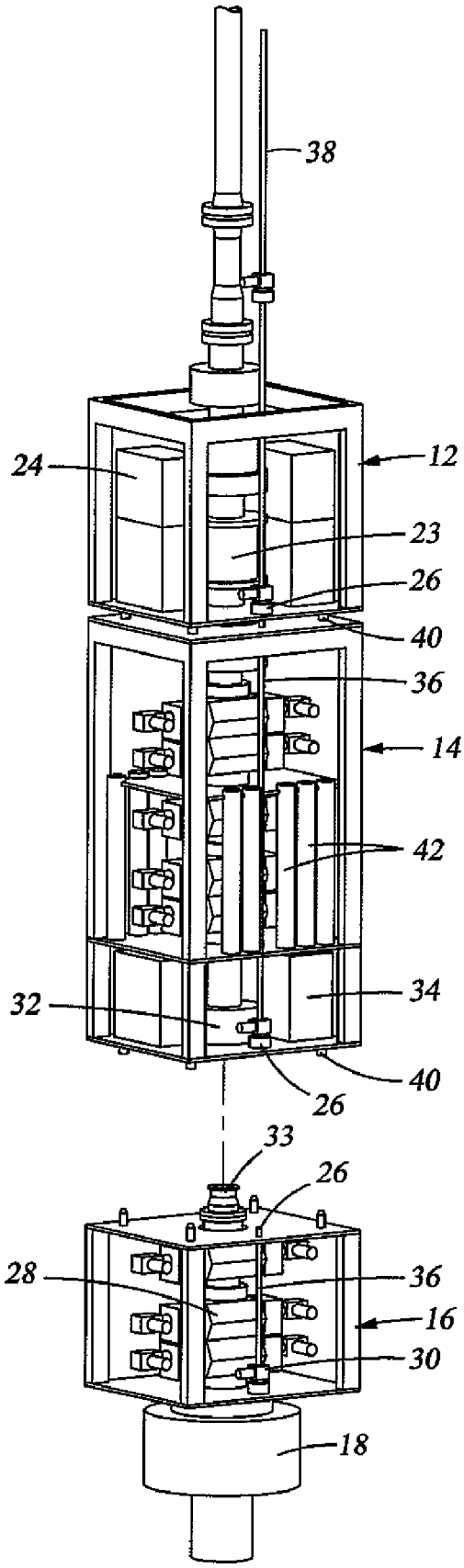
FIG. 2 is an isometric view of a blowout preventer stack system constructed in accordance with embodiments of the present invention.

LMRP 12 and BOP stack 14 are coupled together by wellbore connector 23 that is engaged with a corresponding mandrel on the upper end of stack 14. As is shown in FIG. 2, BOP stack 14 is similarly coupled to ABP 16 by connector 32 that engages mandrel 33 on ABP 16. Both LMRP 12 and BOP stack 14 comprise re-entry and alignment systems 40 that allow the LMRP 12/BOP stack 14 and stack 14/ABP 16 connections to be made subsea with all the auxiliary connections (i.e. control pods, choke/kill lines) aligned. Choke/kill line connectors 26 interconnect choke/kill lines 36 and choke/kill valves 30 on stack 14 and ABP 16 to choke/kill lines 38 on riser connector 20.

Control pods 24 of LMRP 12 provide control signals to BOP stack 14 while auxiliary control pods 34 on BOP stack 14 provide control signals to ABP 16. In certain embodiments, ram BOP's 28 in ABP 16 are controlled by auxiliary control pods 34, which may be communicatively linked to control pods 24 via umbilical jumpers or some other releasable connection. In certain embodiments, the control functions for ram BOP's 28 of ABP 16 (as well as control functions for other equipment) may be integrated into control pods 24 on LMRP 12, thus eliminating the need for auxiliary control pods 34. Because ABP 16 is operated with BOP stack 14, hydraulic accumulator bottles 42 mounted on the BOP stack can be used to support operation of the ABP. ABP 16 may also comprise a remotely operated vehicle (ROV) panel that provides control of the ABP functions by an ROV.

LMRP 12 and BOP stack 14 are similar to, and can operate as, a convention two-component stack assembly. ABP 16 is installed between wellhead 18 and BOP stack 14 and provides additional ram BOP's 28 to provide redundancy and increase effective service life. In certain embodiments, ABP 16 will not be lowered from the rig to the wellhead on a conventional riser with the rest of the BOP stack but will be deployed separately. This separate deployment can be accomplished on drill pipe, heavy wireline, or any other means, either from the drilling rig if it has a dual activity derrick, from another rig (perhaps of lesser drilling capabilities), or from a heavy duty workboat or tender vessel. In addition to being run, the ABP 16 could be stored and serviced by a vessel other than the drilling rig, thus eliminating the need for additional storage space and handling capacity on the drilling rig.

Figure 3A:
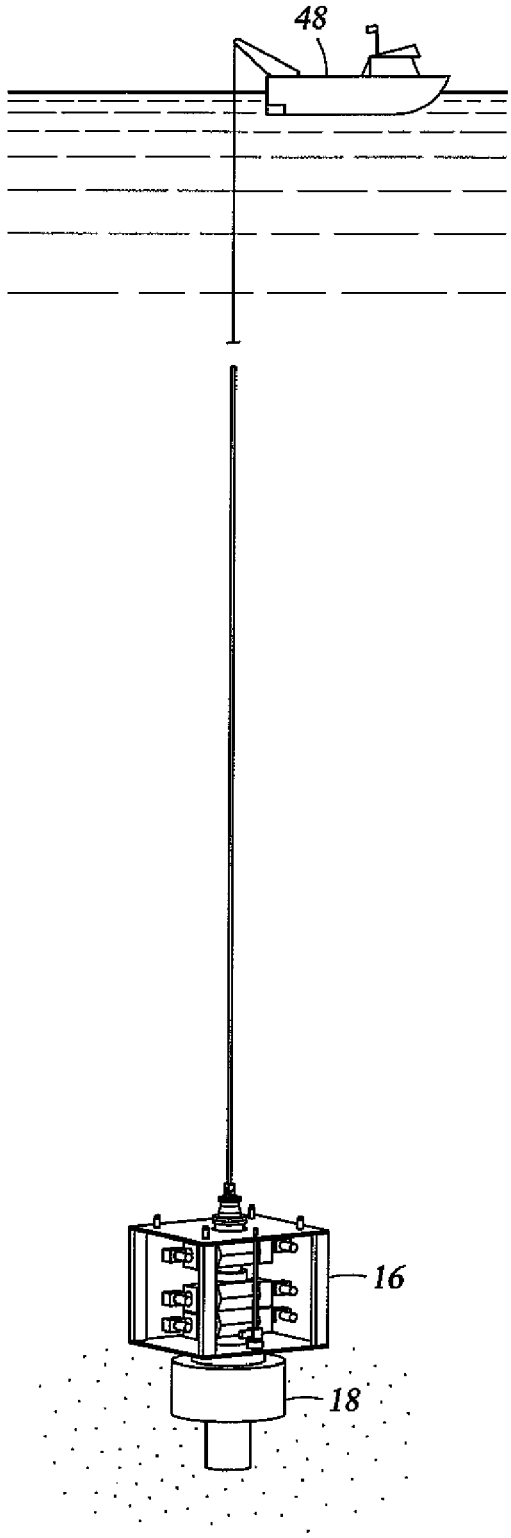
FIGS. 3A and 3B illustrate the deployment and utilization of a blowout preventer stack system constructed in accordance with embodiments of the present invention with a single wellhead.
Figure 3B:
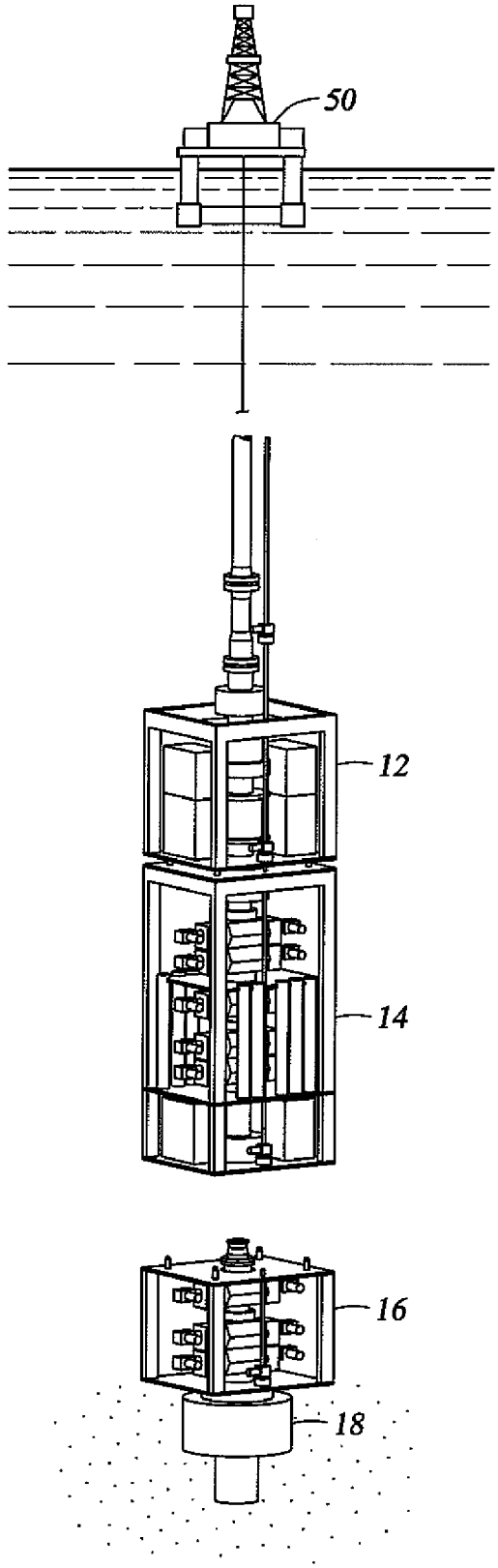

Referring now to FIGS. 3A and 3B, a single ABP 16 can be landed on wellhead 18 via drill string, wireline, or other non-riser system by service vessel 48 prior to drilling rig 50 arriving on site. Drilling rig 50 would then run the BOP stack 14 and LMRP 12 assembly on conventional drilling riser and land the stack on ABP 16. Normal drilling operations could utilize the ram BOP's of ASP 16 until their useful life was reached. At that point, drilling could continue with the ram BOP's of BOP stack 14 without disturbing the stack assembly, thus increasing drilling time before having to bring the stack to the surface for maintenance.

Figure 4:
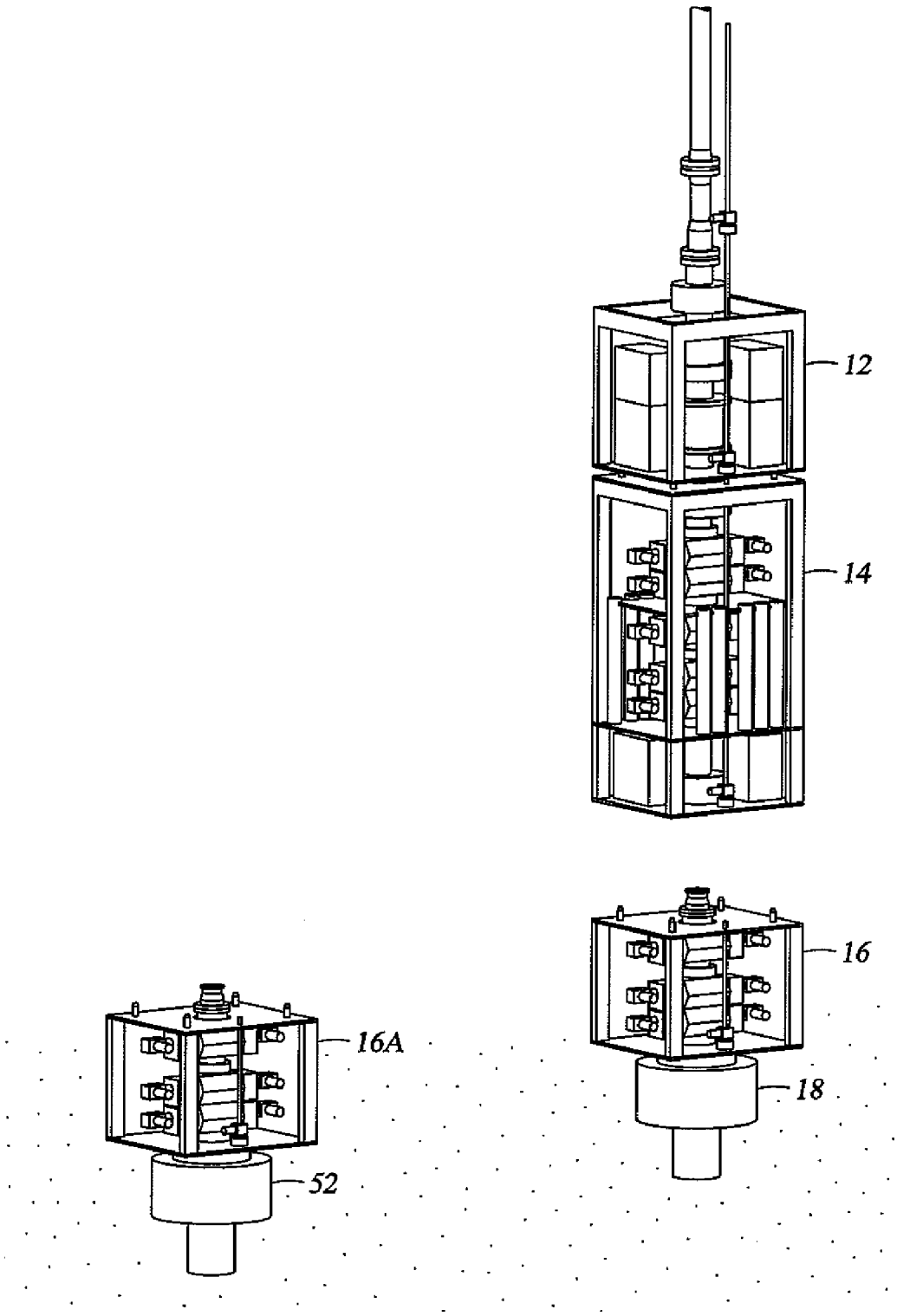
FIG. 4 illustrates the deployment and utilization of a blowout preventer stack system constructed in accordance with embodiments of the present invention with a single wellhead and a parking pile.

Referring now to FIG. 4, a drilling site may comprise a wellhead 18 and a parking pile 52. Parking pile 52 provides a location for the subsea storage of an additional ABP 16. A first ABP 16 can be run as described above in reference to FIG. 3A by service vessel 48. BOP stack 14 and LMRP 16 can then be run by a drilling rig and drilling operations performed using the ram BOP's in ABP 16. Before the useful life of the ram BOP's in ABP 16 is reached, a replacement ABP 16A can be run by a service vessel and landed on parking pile 52. When the first ABP 16 needs to be serviced, stack 14 and LMRP 12 can be disconnect from the ASP but remain subsea. Once ABP 16 is pulled to the surface for servicing, replacement ABP 16A can be disconnected form parking pile 52 and landed on wellhead 18. Replacement ABP 16A can be moved from parking pile 52 to wellhead 18 by drilling rig 50 by landing BOP stack 14 on ABP 16A and then moving the entire assembly together. Replacement ABP 16A can also be moved onto wellhead 18 by a service vessel as BOP stack 14 is supported by the drilling rig.

Figure 5A:
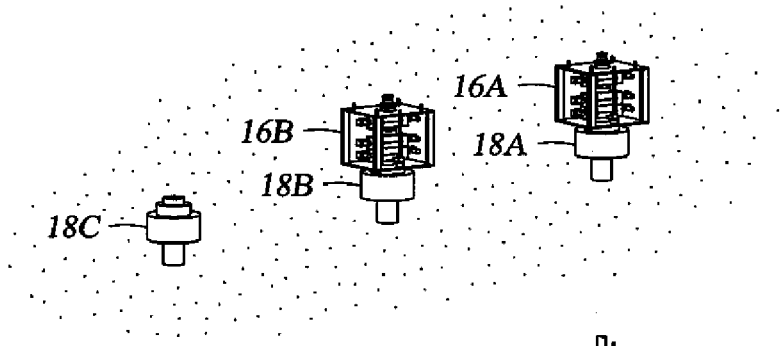
FIGS. 5A-5C illustrate the deployment and utilization of a blowout preventer stack system constructed in accordance with embodiments of the present invention with a plurality of wellheads.
Figure 5B:
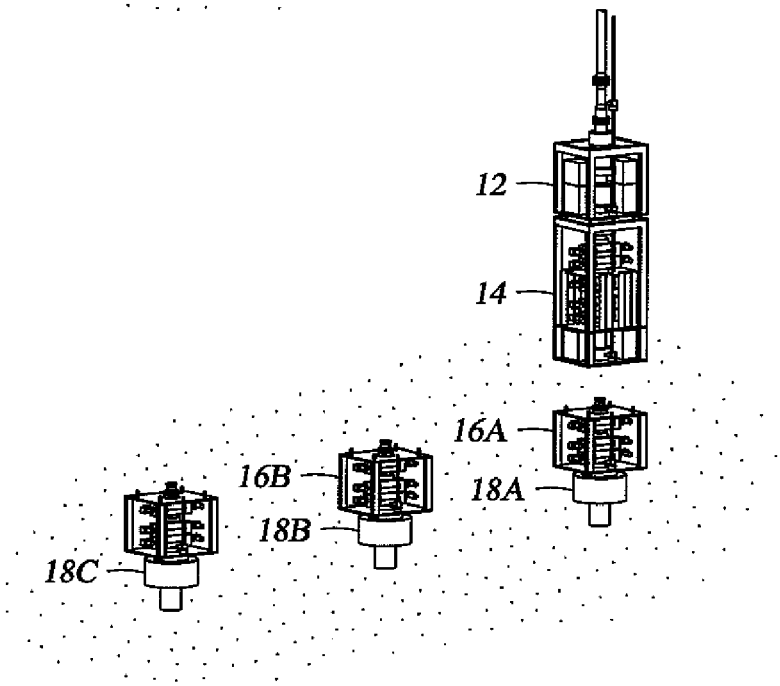
Figure 5C:
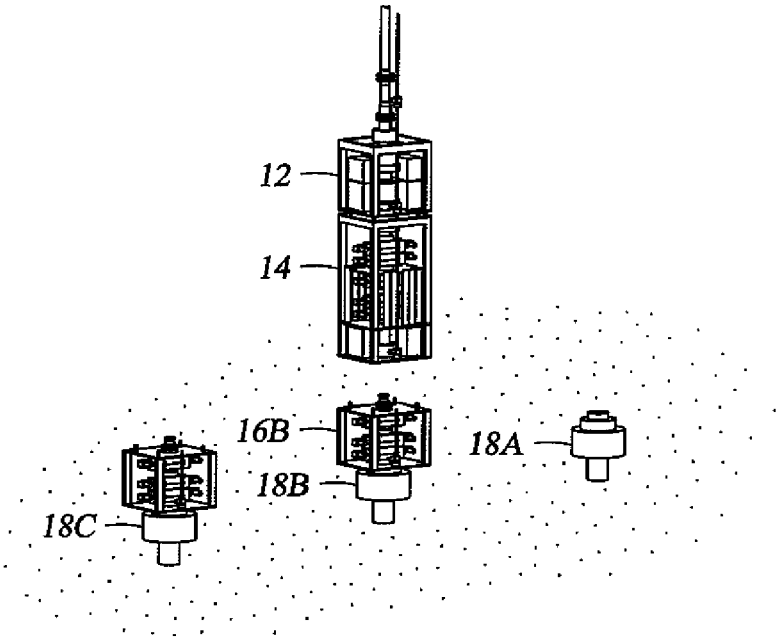

Referring now to FIGS. 5A-5C, multiple ABP systems 16A-16B can be used to drill multiple wells on a plurality of wellheads 18A-18C. A first ABP 16A can be deployed onto wellhead 18A with BOP stack 14 and LMRP 12 being run and landed atop ABP 16A and drilling operations commenced. While the first well is being drilled, a second ABP 16B is deployed and landed onto the next wellhead 18B. When the first well is completed, the BOP stack 14 and LMRP 12 can simply be unlatched, lifted, relocated the second wellhead 18B and landed on second ABP 16B. While the second well is being completed, the first ABP 16A can be retrieved from the first wellhead 18A and moved to a third wellhead 18C, or brought back to the surface for maintenance or repair.

Under any of the uses of an ABP as described above, the ram BOP cavities in the ABP can be considered the primary cavities while the ram BOP cavities in the BOP stack would then be considered the secondary cavities. This would allow the BOP stack and LMRP to stay down almost indefinitely because the secondary cavities in the BOP stack would only be utilized after the primary cavities in the ABP were rendered inoperable. And the primary BOP cavities in the ABP could be retrieved to the surface and maintained while the BOP stack and LMRP were drilling atop another ABP.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the override apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A subsea blowout preventer stack deployment method comprising:

coupling a drilling riser to a lower marine riser package that is releasably connected to a blowout preventer stack;

lowering the lower marine riser package and blowout preventer stack toward a subsea wellhead;

landing the blowout preventer stack on a first additional blowout preventer package that is coupled to the subsea wellhead, wherein the first additional blowout preventer package comprises a ram blowout preventer;

deploying a second additional blowout preventer package to a subsea location;

disconnecting the blowout preventer stack from the first additional blowout preventer package; and landing the blowout preventer stack on the second additional blowout preventer package.

2. The subsea blowout preventer stack deployment method of claim 1, wherein the drilling riser is not used to deploy and land the first additional blowout preventer package on the subsea wellhead.

3. The subsea blowout preventer stack deployment method of claim 2, wherein the first additional blowout preventer package is not deployed by a drilling rig.

4. The subsea blowout preventer stack deployment method of claim 1, wherein the blowout preventer stack comprises a connector that is operable to engage a mandrel disposed on the first additional blowout preventer package.

5. The subsea blowout preventer stack deployment method of claim 1, further comprising:

deploying the second additional blowout preventer package to a second subsea wellhead; and wherein the blowout preventer stack is landed on the second additional blowout preventer package without retrieving the blowout preventer stack to the surface.

6. The subsea blowout preventer stack deployment method of claim 1, further comprising:

deploying the second additional blowout preventer package to a subsea parking pile;

disconnecting the blowout preventer stack from the first additional blowout preventer package;

landing the blowout preventer stack on the second additional blowout preventer package;

disconnecting the first additional blowout preventer package from the subsea wellhead and retrieving it to the surface; and landing the blowout preventer stack and the second additional blowout preventer package on the subsea wellhead.

7. The subsea blowout preventer stack deployment method of claim 6, wherein the drilling riser is not used to deploy the second additional blowout preventer package.

8. The subsea blowout preventer stack deployment method of claim 6, wherein a drilling rig is not used to deploy the second additional blowout preventer package or retrieve the first additional blowout preventer package.

9. A subsea drilling method comprising:

deploying a first additional blowout preventer package to a subsea wellhead, wherein the first additional blowout preventer package comprises a ram blowout preventer;

utilizing a drilling riser to deploy a lower marine riser package and a blowout preventer stack from a drilling rig;

landing the blowout preventer stack on the first additional blowout preventer package;

performing drilling operations with the drilling rig while utilizing the ram blowout preventer in the first additional blowout preventer package;

deploying a second additional blowout preventer package to a subsea location;

disconnecting the blowout preventer stack from the first additional blowout preventer package; and landing the blowout preventer stack on the second additional blowout preventer package.

10. The subsea drilling method of claim 9, wherein the drilling riser is not used to deploy the first additional blowout preventer package on the subsea wellhead.

11. The subsea drilling method of claim 10, wherein the drilling rig is not used to deploy the first additional blowout preventer package.

12. The subsea drilling method of claim 9, further comprising:

deploying the second additional blowout preventer package to a second subsea wellhead; and wherein the blowout preventer stack is landed on the second additional blowout preventer package without retrieving the blowout preventer stack to the surface.

13. The subsea drilling method of claim 9, further comprising:

deploying the second additional blowout preventer package to a subsea parking pile;

disconnecting the blowout preventer stack from the first additional blowout preventer package;

landing the blowout preventer stack on the second additional blowout preventer package;

disconnecting the first additional blowout preventer package from the subsea wellhead and retrieving it to the surface; and landing the blowout preventer stack and the second additional blowout preventer package on the subsea wellhead.

14. The subsea drilling method of claim 13, wherein the drilling rig is not used to deploy the second additional blowout preventer package or retrieve the first additional blowout preventer package.

* * * * *